US010415851B2

(12) United States Patent
Watts et al.

(10) Patent No.: US 10,415,851 B2
(45) Date of Patent: Sep. 17, 2019

(54) HOT WATER HEATING SYSTEM CONTROLLER AND METHOD OF USING THE SAME

(71) Applicant: Energx Controls, Inc., Cypress, CA (US)

(72) Inventors: Luther Jerry Watts, Winnetka, CA (US); Timothy Dale Krause, Cypress, CA (US)

( * ) Notice: Subject to any disclaimer, the term of this patent is extended or adjusted under 35 U.S.C. 154(b) by 351 days.

(21) Appl. No.: 15/201,215

(22) Filed: Jul. 1, 2016

(65) Prior Publication Data

US 2017/0003052 A1 Jan. 5, 2017

Related U.S. Application Data

(60) Provisional application No. 62/187,787, filed on Jul. 1, 2015.

(51) Int. Cl.
*F24H 9/20* (2006.01)

(52) U.S. Cl.
CPC ..... *F24H 9/2007* (2013.01); *F24H 9/2021* (2013.01)

(58) Field of Classification Search
CPC ..... F24H 9/2007; F24H 9/2021
USPC ..... 122/14.1, 14.22; 392/454
See application file for complete search history.

(56) References Cited

U.S. PATENT DOCUMENTS

2006/0257127 A1* 11/2006 Patterson ..... F24D 19/1051 392/441
2013/0173205 A1* 7/2013 Van Houten ..... G01K 3/06 702/136
2014/0277816 A1* 9/2014 Branecky ..... G05D 23/1923 700/300
2015/0040672 A1* 2/2015 Meyer ..... G01L 19/0092 73/700

* cited by examiner

*Primary Examiner* — Steven B McAllister
*Assistant Examiner* — Benjamin W Johnson
(74) *Attorney, Agent, or Firm* — Lewis Roca Rothgerber Christie LLP

(57) ABSTRACT

A temperature control system for controlling a water heater to adjust the temperature of water in a water storage tank, the control system including a first temperature sensor coupled to the storage tank and configured to measure a first temperature of the water at a first location within the storage tank, a second temperature sensor coupled to the storage tank and configured to measure a second temperature of the water at a second location within the storage tank, and a controller coupled to the first and second temperature sensors and configured to turn ON the water heater when the measured first and second temperatures are below a first setpoint temperature, and to turn OFF the water heater when the measured first and second temperatures are at or above a second setpoint temperature.

17 Claims, 2 Drawing Sheets

HOT WATER HEATING SYSTEM CONTROLLER AND METHOD OF USING THE SAME

CROSS-REFERENCE TO RELATED APPLICATION(S)

The present application claims priority to and the benefit of U.S. Provisional Application No. 62/187,787, filed Jul. 1, 2015, entitled "HOT WATER HEATING SYSTEM CONTROLLER AND METHOD OF USING THE SAME", the entire content of which is incorporated herein by reference.

BACKGROUND

1. Field

The present invention relates to the field of hot water supply systems and heating systems for domestic and industrial use.

2. Description of Related Art

Conventional water heaters sometimes fail due to moisture-caused material degradation that accumulates in the internal elements of the heater, causing materials therein to leak and lose their mechanical integrity. This form of failure often occurs when a heater is actuated for only a short period of time. Typically, when a heater has cooled, heated gases may precipitate water on the cold elements. When the heater is allowed to fully warm up, the moisture condensation is driven off by the high temperature. However, in a system with short ON cycles, a heater may never reach sufficient temperature to drive off the condensation.

Additionally, heaters that operate at short ON cycles often make inefficient use of energy. Because the inner elements of the water heater are initially cool, a certain amount of energy from the gas or electricity that is intended for heating water is consumed by heating up the internal structure of the heater. As such, frequent short operations of the heater lead to more energy being wasted by the heating of the internal elements.

In water heaters attached to a storage tank, a common method of control is to sense the temperature at a single point, either at the top or at the bottom of the storage tank. When temperature is sensed at the top, because of the stratification of hot and cold water (with hot water rising to the top of the tank), the top sensor may turn the heater OFF when the top strata of water has reached the high setpoint temperature, even when the lower portion of the tank, which may constitute a large part of the tank, is still filled with cooler water.

Alternatively, when using only a bottom sensor, the heater may be turned ON when only a small amount of cold water has entered the bottom of the storage tank. This small amount of cold water will quickly be heated to the proper temperature, resulting in a very short ON cycle of the heater.

Thus, what is desired is a control mechanism for reducing the frequency of short ON cycles and increasing the cycle time in a water heater system to improve the energy efficiency and extend the water heater's lifetime.

SUMMARY

Aspects of embodiments of the present invention are directed to a system for limiting short ON cycles of a water heater to enable energy savings and reduce stress on the water heater.

Embodiments of the present invention prevent short cycling by ensuring that the heater is not turned ON before all of the water above the setpoint temperature is consumed, and then not turned OFF until all of the water below the setpoint temperature has been heated above the setpoint temperature. This ensures that the thermal energy capability of the storage tank is fully utilized and that the heater is not unnecessarily actuated.

According to embodiments of the invention, the temperature of the storage tank water is sensed at two different locations, one near the bottom of the tank, and one near the exit (e.g., hot water supply outlet) at the top of the tank.

Embodiments of the present invention may be employed in community water heating systems, hotels, motels, apartment complexes, dormitories, or any other facility where a number of users of hot water are located remotely from the heater and water storage tank.

According to embodiments of the invention, there is provided a temperature control system for controlling a water heater to adjust the temperature of water in a water storage tank, the temperature control system including: a first temperature sensor coupled to the water storage tank and configured to measure a first temperature of the water at a first location within the water storage tank; a second temperature sensor coupled to the water storage tank and configured to measure a second temperature of the water at a second location within the water storage tank; and a controller coupled to the first and second temperature sensors and configured to turn the water heater ON when the measured first and second temperatures are below a first setpoint temperature, and to turn the water heater OFF when the measured first and second temperatures are at or above a second setpoint temperature.

The first setpoint temperature may be substantially the same as the second setpoint temperature. The second setpoint temperature may be higher than the first setpoint temperature by a temperature differential, which may be between about 3 and about 4 degrees Fahrenheit.

The first and second temperature sensors may be configured to measure the first and second temperatures at regular intervals.

The first temperature sensor may be configured to measure the first temperature at a first frequency when a previously measured first temperature is within a range of the first setpoint temperature, and to measure the first temperature at a second frequency when the previously measured first temperature is outside of the range of the first setpoint temperature, the first frequency being greater than the second frequency. The second temperature sensor may be similarly configured.

According to embodiments of the invention, there is provided a temperature control system for controlling a water heater to adjust the temperature of water in a water storage tank, the temperature control system including: a first temperature sensor coupled to the water storage tank and configured to measure a first temperature of the water at a bottom location within the water storage tank; a second temperature sensor coupled to the water storage tank and configured to measure a second temperature of the water at a top location within the water storage tank; and a controller coupled to the first and second temperature sensors and configured to turn the water heater ON when the measured second temperature is below a low setpoint temperature, and to turn the water heater OFF when the measured first temperature is at or above a high setpoint temperature.

According to embodiments of the invention, there is provided a hot water supply system including: a storage tank including water; a water heater coupled to the storage tank and configured to heat the water; a first temperature sensor coupled to the storage tank and configured to measure a first temperature of the water at a first location within the storage tank; a second temperature sensor coupled to the storage tank and configured to measure a second temperature of the water at a second location within the storage tank; and a controller coupled to the first and second temperature sensors and configured to turn the water heater ON when the measured first and second temperatures are below a first setpoint temperature, and to turn the water heater OFF when the measured first and second temperatures are at or above a second setpoint temperature.

According to embodiments of the invention, there is provided a method of controlling a water heater to adjust the temperature of water in a water storage tank, the method including: measuring, by a first temperature sensor coupled to the water storage tank, a first temperature of the water at a first location within the water storage tank; measuring, by a second temperature sensor coupled to the water storage tank, a second temperature of the water at a second location within the water storage tank; and automatically controlling the water heater, by a controller coupled to the first and second temperature sensors, to turn the water heater ON when the measured first and second temperatures are below a first setpoint temperature, and to turn the water heater OFF when the measured first and second temperatures are at or above a second setpoint temperature.

BRIEF DESCRIPTION OF THE DRAWINGS

The accompanying drawings, together with the specification, illustrate exemplary embodiments of the present invention, and, together with the description, serve to explain aspects of embodiments of the present invention. In the drawings, like reference numerals are used throughout the figures to reference like features and components. The figures are not necessarily drawn to scale. The above and other features and aspects of the present invention will become more apparent by the following detailed description of illustrative embodiments with reference to the attached drawings, in which.

DETAILED DESCRIPTION

Figure 1:
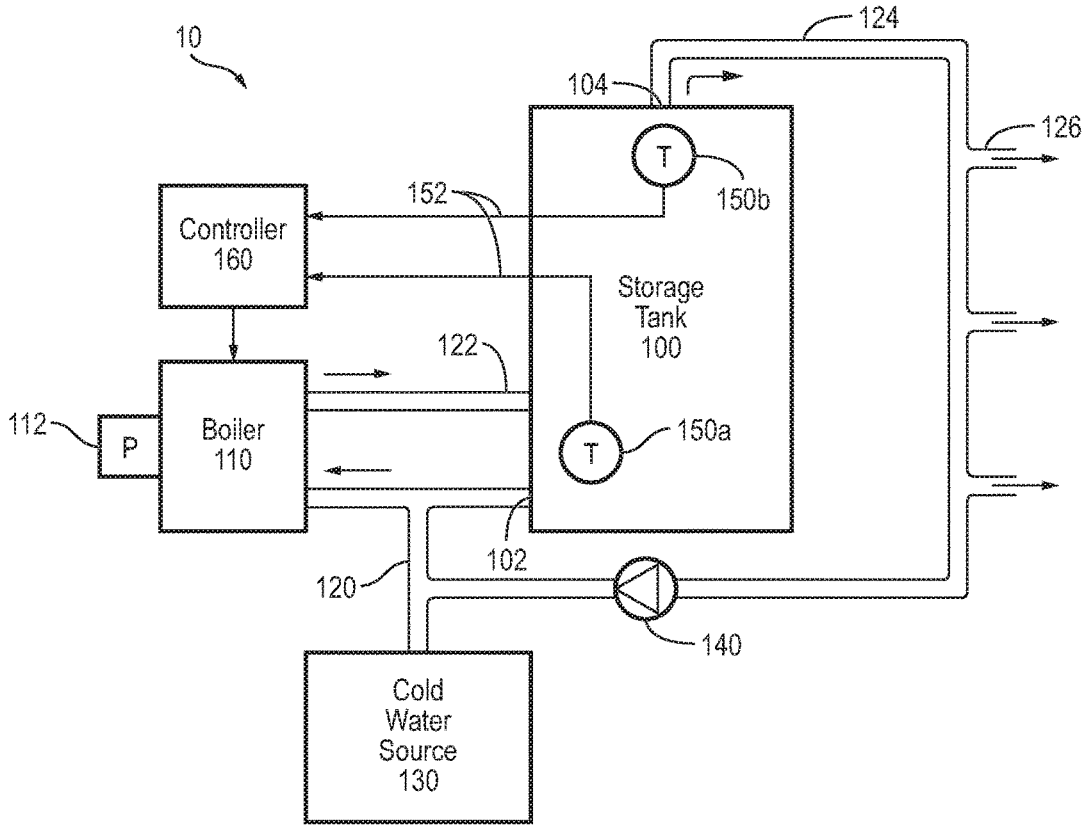
FIG. 1 is a schematic diagram of a hot water system according to an illustrative embodiment of the present invention.

FIG. 1 is a schematic diagram of a hot water supply system 10, according to an illustrative embodiment of the present invention.

According to an embodiment, the hot water supply system (e.g., a domestic/recirculating hot water supply system) 10 includes a water storage tank 100, a water heater (e.g., boiler) 110, an aquastat 112 for controlling and maintaining the water temperature at the water heater 110, a cold water conduit (e.g., cold water pipe) 120 for providing cold water to the recirculation system from a cold water source 130, a hot water conduit (e.g., hot water pipe) 122 for supplying hot water from the water heater 110 to the storage tank 100, a supply conduit (e.g., hot water supply pipe) 124 for providing hot water to one or more water outlets (e.g., taps) 126, a pump (e.g., a circulation pump) 140 for circulating the water from the storage tank 100 to the one or more water outlets 126, first and second temperature sensors 150*a* and 150*b*, and a controller 160 for controlling the water heater 110 based on signals from the top and bottom temperature sensors 150*a* and 150*b*. The arrows along the conduits are indicative of the direction of water flow in the recirculation hot water supply system 10.

According to an embodiment, the storage tank 100 and the water heater 110 may be combined into one unit. For example, water heater 110 may be one or more heating elements (e.g., heating coils) located at various suitable locations within the storage tank 100 (e.g., at the bottom or mid-section of the storage tank 100).

The first temperature sensor 150*a* may be located in the lower portion of the storage tank 100 (e.g., near the cold water outlet 102) and the second temperature sensor 150*b* may be located in the top portion of the storage tank 100 (e.g., near the hot water outlet 104). As convection causes hot water to rise to the top, under stable operating conditions, the temperature reading of the temperature sensor 150*b* may be higher than that of the temperature sensor 150*a*.

In an embodiment, each of the first and second temperature sensors 150*a* and 150*b* includes a plurality of temperature sensors that are distributed over a volume or a horizontal plane of the storage tank 100 (e.g., distributed in a lateral ring formation inside the storage tank 100). As such, the first and second temperature sensors 150*a* and 150*b* may produce temperature readings that are more accurately representative of the temperature of water at the top and bottom sense locations and less susceptible to local temperature variations.

The first and second temperature sensors 150*a* and 150*b* may communicate the temperature readings to the controller 160 through wired electrical connections (such as electrical wires or cables) 152 and/or through a wireless link. The wireless link may employ a short-range or midrange wireless communication protocol such as bluetooth, infrared data association (IrDA), wireless personal area networks (WPAN), wireless local area networks (WLAN) such as 802.11a/b/g/n, and/or the like. The signal transmission through the wireless link may be encoded/encrypted to prevent tampering with the wireless signal by an outside entity (such as a "hacker") or to make the wireless connection less susceptible to electrical noise produced by the electrical circuits within close proximity of the hot water supply system 10 and/or the outside environment.

In an embodiment, the controller 160 includes electronic circuitry (such as a circuit board having one or more microcontrollers) for receiving temperature signals from the first and second temperature sensors 150*a* and 150*b* and controlling the water heater 110 (e.g., actuating it ON and OFF) based on the temperature signals according to a control algorithm. The controller 160 is configured to reduce (e.g., prevent) short-cycling of the water heater 110 by ensuring that the water heater 110 is not turned ON before all of (or substantially all of) the water that is at or above a first setpoint temperature is consumed, and then to not turn OFF the water heater 110 until all of (or substantially all of) the water that is below a second setpoint temperature has been heated to above the setpoint temperature. Accordingly, the controller 160 is configured to ensure that the thermal energy capability of the storage tank 100 is fully utilized. In an example, the first setpoint temperature may be the same as the second setpoint temperature, which may be about 60 to about 240 degrees Fahrenheit. However, embodiments of the present invention are not limited thereto and the first and second setpoint temperatures may have different values. For example, the first setpoint temperature may be about 60 to about 240 degrees Fahrenheit, and the second setpoint temperature may be about 80 to about 240 degrees Fahrenheit, but higher than the first setpoint temperature.

According to an embodiment, the controller 160 turns the water heater 110 ON when both of the first and second temperature sensors 150*a* and 150*b* detect that the water in the storage tank 100 at the corresponding sense locations (e.g., at the top and bottom of the storage tank 100) are below the first setpoint temperature (i.e., both the first and second temperature sensors 150*a* and 150*b* report an under-temperature condition). Further, the controller 160 turns the water heater 110 OFF when both of the first and second temperature sensors 150*a* and 150*b* detect that the water in the storage tank 100 at the corresponding sense locations (e.g., at the top and bottom of the storage tank 100) are at or above the second setpoint temperature (i.e., both the first and second temperature sensors 150*a* and 150*b* report an over-temperature condition). Thus, when only one of the first and second temperature sensors 150*a* and 150*b* indicates an over/under-temperature condition, the water heater 110 does not change state and remains ON if previously ON, and OFF if previously OFF.

In an example, the first and second setpoint temperatures may be substantially the same. In other embodiments, the first and second setpoint temperatures may be offset by a few degrees to ensure a delay (e.g., a preset minimum delay) in cycling of the water heater 110. For example, the second setpoint temperature may be higher than the first setpoint temperature by a temperature differential or offset. Increasing the offset leads to longer time lapses (e.g., delays) between the on/off cycles of the water heater 110 and to more efficient operation of the water heater 110. However, if the offset (e.g., the temperature differential) is increased beyond a certain point, the water user may detect a temperature fluctuation at points within the facility (e.g., at the taps 126). In an embodiment, the offset is set within a range of three to four degrees Fahrenheit.

According to an embodiment, the controller 160 may sample the water temperature using the first and second temperature sensors 150*a* and 150*b* at regular time intervals. In another embodiment, the controller 160 may sample water temperature at variable intervals. For example, when a sensed first/second temperature is within a range (e.g., a preset range) of the first/second set point temperature, the temperature may be sampled at a first frequency (e.g., a high frequency corresponding with a short time interval), and when the sensed first/second temperature is outside of the range of the first/second set point temperature, the temperature may be sampled at a second frequency (e.g., a low frequency corresponding with a long time interval). As such, the controller 160 may reduce (e.g., prevent or eliminate) temperature overshoots/undershoots. The range of the first/second set point temperature may be about 1 to about 4 degrees Fahrenheit (e.g., +/−2 degrees Fahrenheit from the first/second set point temperature), depending on the value of the first and second setpoint temperatures (e.g., a smaller setpoint temperature may have a tighter range, and vice versa). Further the first and second sampling frequencies may generally be within 1 sample every 2 to 120 seconds. For example, the first sampling frequency may be about 1 sample every 2 to 5 seconds, while the second sampling frequency may be about 1 sample every 60 to 120 seconds.

According to an embodiment, the controller 160 turns the water heater ON when the measured second temperature is below the first setpoint temperature (e.g., a low setpoint temperature), and turns the water heater OFF when the measured first temperature is at or above the second setpoint temperature (e.g., a high setpoint temperature). The first temperature may be measured by the first temperature sensor at a bottom location within the water storage tank 100, and the second temperature may be measured by the second temperature sensor at a top location within the water storage tank 100.

Figure 2A:
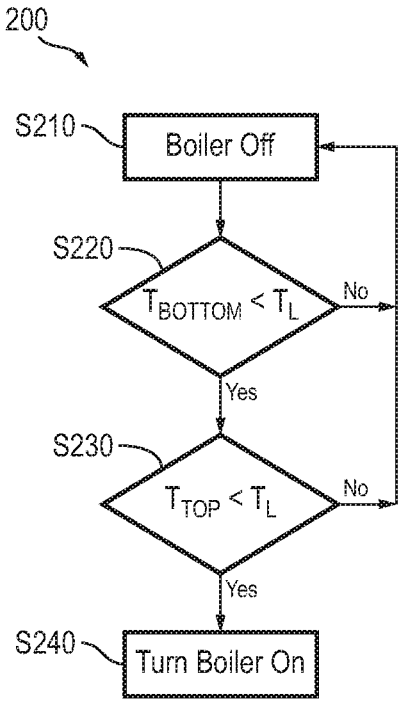
FIG. 2A is a flow diagram of the logic of a controller that transitions the hot water supply system from an OFF state to an ON state, according to an illustrative embodiment of the present invention.

FIG. 2A is a flow diagram of the control logic 200 of the controller 160 that transitions the hot water supply system 10 from an OFF state to an ON state, according to an illustrative embodiment of the present invention.

In block S210 the hot water supply system 10 is at a desired temperature (e.g., is at or above the first setpoint temperature $T_L$) and the water heater 110 is OFF.

In block S220, the controller 160 determines whether or not the temperature reading from the first temperature sensor (e.g., the bottom temperature sensor) 150*a* is below the first setpoint temperature $T_L$. If not, the water heater 110 remains OFF. If the sensed temperature at the first temperature sensor 150*a* is below the first setpoint temperature $T_L$ (as may occur over time as the storage tank 100 cools down), the control logic 200 proceeds to block S230.

In block S230, the controller 160 determines whether or not the temperature reading from the second temperature sensor (e.g., the top temperature sensor) 150*b* is below the first setpoint temperature $T_L$. If not, the water heater 110 remains OFF. If the sensed temperature at the second temperature sensor 150*b* is below the first setpoint temperature $T_L$, the control logic 200 proceeds to block S240.

In block 240, the controller 160 turns the water heater 110 back ON to heat the water within the storage tank 100 to raise the water temperature back up to the desired temperature point.

Figure 2B:
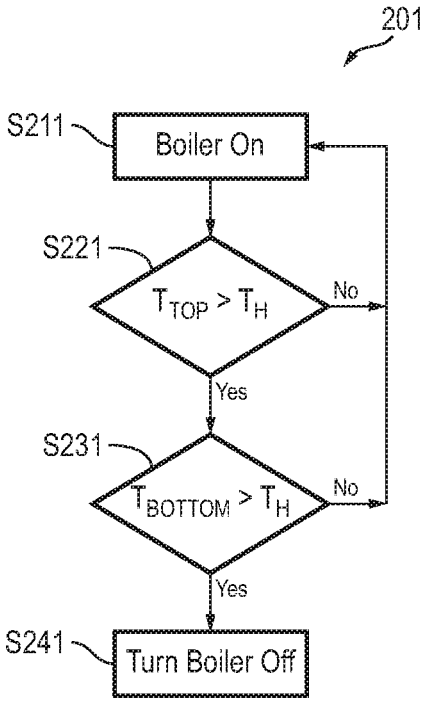
FIG. 2B is a flow diagram of the logic of the controller that transitions the hot water supply system from an ON state to an OFF state, according to an illustrative embodiment of the present invention.

FIG. 2B is a flow diagram of the control logic 201 of the controller 160 that transitions the hot water supply system 10 from an ON state to an OFF state, according to an illustrative embodiment of the present invention.

In block S211 the hot water supply system 10 is not at an adequate temperature (e.g., is below the second setpoint temperature $T_H$) and the water heater 110 is on.

In block S221, the controller 160 determines whether or not the temperature reading from the second temperature sensor (e.g., the top temperature sensor) 150*b* is at or above the second setpoint temperature $T_H$. If not, the water heater 110 remains on. If the sensed temperature at the second temperature sensor 150*b* is at or above the second setpoint temperature $T_H$ (as may occur over time as the storage tank 100 heats up from a cold state), the control logic 201 proceeds to block S231.

In block S231, the controller 160 determines whether or not the temperature reading from the first temperature sensor (e.g., the bottom temperature sensor) 150*a* is at or above the first setpoint temperature $T_H$. If not, the water heater 110 remains on. If the sensed temperature at the second temperature sensor 150*a* is at or above the first setpoint temperature $T_H$, the control logic 201 proceeds to block S241.

In block 241, the controller 160 turns the water heater 110 OFF as the water within the storage tank 100 is at the desired temperature point.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of" when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The controller and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the controller may be formed on one integrated circuit (IC) chip or on separate IC chips. Further, the various components of the controller may be implemented on a flexible printed circuit film, a tape carrier package (TCP), a printed circuit board (PCB), or formed on a same substrate. Further, the various components of the controller may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

While this invention has been described in detail with particular references to illustrative embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims and equivalents thereof.

What is claimed is:

1. A temperature control system for controlling a water heater to adjust the temperature of water in a water storage tank, the temperature control system comprising:

a first temperature sensor coupled to the water storage tank and configured to measure a first temperature of the water at a first location within the water storage tank;

a second temperature sensor coupled to the water storage tank and configured to measure a second temperature of the water at a second location within the water storage tank; and a controller coupled to the first and second temperature sensors and configured to turn the water heater ON when the measured first and second temperatures are below a first setpoint temperature, and to turn the water heater OFF when the measured first and second temperatures are at or above a second setpoint temperature, wherein the first temperature sensor is configured to measure the first temperature at a first frequency when a previously measured first temperature is within a range of the first setpoint temperature, and to measure the first temperature at a second frequency when the previously measured first temperature is outside of the range of the first setpoint temperature, the first frequency being greater than the second frequency.

2. The temperature control system of claim 1, wherein the first setpoint temperature is substantially the same as the second setpoint temperature.

3. The temperature control system of claim 1, wherein the second setpoint temperature is higher than the first setpoint temperature by a temperature differential, and wherein the temperature differential is between about 3 and about 4 degrees Fahrenheit.

4. The temperature control system of claim 1, wherein the first and second temperature sensors are configured to measure the first and second temperatures periodically.

5. The temperature control system of claim 1, wherein the range of the first setpoint temperature is about 1 to about 4 degrees Fahrenheit deviation from the first setpoint temperature, wherein the first frequency is about 1 sample every 2 to 5 seconds, and the second frequency is about 1 sample every 60 to 120 seconds.

6. The temperature control system of claim 1, wherein the second temperature sensor is configured to measure the second temperature at a first frequency when a previously measured second temperature is within a range of the second setpoint temperature, and to measure the second temperature at a second frequency when the previously measured second temperature is outside of the range of the second setpoint temperature, the first measurement frequency of the second temperature being greater than the second measurement frequency of the second temperature.

7. The temperature control system of claim 6, wherein the range of the second setpoint temperature is about 1 to about 4 degrees Fahrenheit deviation from the second setpoint temperature, wherein the first measurement frequency of the second temperature is about 1 sample every 2 to 5 seconds, and the second measurement frequency of the second temperature is about 1 sample every 60 to 120 seconds.

8. A temperature control system for controlling a water heater to adjust the temperature of water in a water storage tank, the temperature control system comprising:

a first temperature sensor coupled to the water storage tank and configured to measure a first temperature of the water at a bottom location within the water storage tank;

a second temperature sensor coupled to the water storage tank and configured to measure a second temperature of the water at a top location within the water storage tank; and a controller coupled to the first and second temperature sensors and configured to turn the water heater ON when the measured second temperature is below a low setpoint temperature, and to turn the water heater OFF when the measured first temperature is at or above a high setpoint temperature, wherein the first temperature sensor is configured to measure the first temperature at a first frequency when a previously measured first temperature is within a range of the high setpoint temperature, and to measure the first temperature at a second frequency when the previously measured first temperature is outside of the range of the high setpoint temperature, the first frequency being greater than the second frequency.

9. The temperature control system of claim 8, wherein the low setpoint temperature is substantially the same as the high setpoint temperature.

10. The temperature control system of claim 8, wherein the high setpoint temperature is higher than the low setpoint temperature by a temperature differential, and wherein the temperature differential is between about 3 and about 4 degrees Fahrenheit.

11. The temperature control system of claim 8, wherein the first and second temperature sensors are configured to measure the first and second temperatures periodically.

12. The temperature control system of claim 8, wherein the second temperature sensor is configured to measure the second temperature at a first frequency when a previously measured second temperature is within a range of the low setpoint temperature, and to measure the second temperature at a second frequency when the previously measured second temperature is outside of the range of the low setpoint temperature, the first measurement frequency of the second temperature being greater than the second measurement frequency of the second temperature.

13. A hot water supply system comprising:

a storage tank comprising water;

a water heater coupled to the storage tank and configured to heat the water;

a first temperature sensor coupled to the storage tank and configured to measure a first temperature of the water at a first location within the storage tank;

a second temperature sensor coupled to the storage tank and configured to measure a second temperature of the water at a second location within the storage tank; and a controller coupled to the first and second temperature sensors and configured to turn the water heater ON when the measured first and second temperatures are below a first setpoint temperature, and to turn the water heater OFF when the measured first and second temperatures are at or above a second setpoint temperature, wherein the first temperature sensor is configured to measure the first temperature at a first frequency when a previously measured first temperature is within a range of the first setpoint temperature, and to measure the first temperature at a second frequency when the previously measured first temperature is outside of the range of the first setpoint temperature, the first frequency being greater than the second frequency.

14. The hot water supply system of claim 13, wherein the second setpoint temperature is higher than the first setpoint temperature by a temperature differential, and wherein the temperature differential is between about 3 and about 4 degrees Fahrenheit.

15. A method of controlling a water heater to adjust the temperature of water in a water storage tank, the method comprising:

measuring, by a first temperature sensor coupled to the water storage tank, a first temperature of the water at a first location within the water storage tank;

measuring, by a second temperature sensor coupled to the water storage tank, a second temperature of the water at a second location within the water storage tank; and automatically controlling the water heater, by a controller coupled to the first and second temperature sensors, to turn the water heater ON when the measured first and second temperatures are below a first setpoint temperature, and to turn the water heater OFF when the measured first and second temperatures are at or above a second setpoint temperature, wherein the measuring of the first temperature comprises:

measuring the first temperature at a first frequency when a previously measured first temperature is within a range of the first setpoint temperature; and measuring the first temperature at a second frequency when the previously measured first temperature is outside of the range of the first setpoint temperature, wherein the first frequency is greater than the second frequency.

16. The method of claim 15, wherein the measuring of the first and second temperatures comprises measuring the first and second temperatures periodically.

17. The method of claim 15, wherein the measuring of the second temperature comprises:

measuring the second temperature at a first frequency when a previously measured second temperature is within a range of the second setpoint temperature; and measuring the second temperature at a second frequency when the previously measured second temperature is outside of the range of the second setpoint temperature, wherein the first measurement frequency of the second temperature is greater than the second measurement frequency of the second temperature.

* * * * *